US009866974B2

(12) United States Patent
Baeuml et al.

(10) Patent No.: US 9,866,974 B2
(45) Date of Patent: Jan. 9, 2018

(54) METHOD FOR OPERATING A HEARING DEVICE SYSTEM, HEARING DEVICE SYSTEM, HEARING DEVICE AND DATABASE SYSTEM

(71) Applicant: SIVANTOS PTE. LTD., Singapore (SG)

(72) Inventors: Robert Baeuml, Eckental (DE); Matthias Froehlich, Erlangen (DE); Simon Huettinger, Erlangen (DE); Bernd Tessendorf, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/202,772

(22) Filed: Jul. 6, 2016

(65) Prior Publication Data

US 2017/0013370 A1 Jan. 12, 2017

(30) Foreign Application Priority Data

Jul. 6, 2015 (DE) ..... 10 2015 212 613

(51) Int. Cl.
*H04R 25/00* (2006.01)

(52) U.S. Cl.
CPC ..... *H04R 25/505* (2013.01); *H04R 25/55* (2013.01); *H04R 25/558* (2013.01); (Continued)

(58) Field of Classification Search
CPC .... H04R 25/55; H04R 25/505; H04R 25/554; H04R 25/556; H04R 25/558; H04R 2225/41; H04R 2225/43; H04R 2225/55
See application file for complete search history.

(56) References Cited

U.S. PATENT DOCUMENTS 6,850,775 B1 * 2/2005 Berg ..... H04R 25/70 381/315
6,870,940 B2 * 3/2005 Meyer ..... H04R 25/558 381/23.1

(Continued)

FOREIGN PATENT DOCUMENTS

DE 102014207311 A1 3/2015
EP 2351383 B1 9/2012

(Continued)

*Primary Examiner* — Matthew Eason
(74) *Attorney, Agent, or Firm* — Laurence A. Greenberg; Werner H. Stemer; Ralph E. Locher

(57) ABSTRACT

A method operates a hearing device system that contains a hearing device and a database system, which is separate from the hearing device and is set up for communication with the hearing device. The method includes ascertaining a piece of location information for a current position of the hearing device and the location information is transmitted to the database. The database then ascertains whether an electronic device that is separate from the hearing device is situated at a prescribed physical distance from the hearing device. The presence of the separate electronic device within the prescribed physical distance is taken as a basis by the database system for creating for the hearing device a parameter set that contains a number of parameters pertaining to the signal processing of audible signals in the hearing device. This parameter set is used by the hearing device for the purpose of signal processing.

11 Claims, 2 Drawing Sheets

(52) U.S. Cl.
CPC ..... *H04R 2225/41* (2013.01); *H04R 2225/43* (2013.01); *H04R 2225/55* (2013.01); *H04R 2460/07* (2013.01)

(56) References Cited

U.S. PATENT DOCUMENTS

| | | | | |
|---|---|---|---|---|
| 8,199,946 | B2 * | 6/2012 | Ritter | H04R 25/554 381/314 |
| 8,588,442 | B2 | 11/2013 | Schmitt et al. | |
| 9,613,028 | B2 * | 4/2017 | Foo | G06F 17/289 |
| 2003/0235319 | A1 * | 12/2003 | Rass | H04R 25/407 381/312 |
| 2008/0123865 | A1 * | 5/2008 | Beck | H04R 25/554 381/23.1 |
| 2009/0208043 | A1 * | 8/2009 | Woods | H04R 25/558 381/315 |
| 2010/0086156 | A1 * | 4/2010 | Rank | H04R 25/554 381/315 |
| 2011/0293123 | A1 * | 12/2011 | Neumeyer | H04R 25/50 381/314 |
| 2012/0321112 | A1 * | 12/2012 | Schubert | H04R 25/43 381/312 |
| 2013/0262101 | A1 * | 10/2013 | Srinivasan | G10L 21/0208 704/226 |
| 2013/0329924 | A1 | 12/2013 | Fleizach et al. | |
| 2014/0153757 | A1 * | 6/2014 | Ku | H04R 25/00 381/317 |
| 2014/0211972 | A1 * | 7/2014 | Kim | H04R 25/70 381/314 |
| 2014/0211973 | A1 * | 7/2014 | Wang | H04W 4/02 381/315 |
| 2015/0003652 | A1 * | 1/2015 | Bisgaard | H04R 25/50 381/314 |
| 2015/0023536 | A1 * | 1/2015 | Scheller | H04R 25/30 381/315 |
| 2015/0030191 | A1 * | 1/2015 | Hasler | H04R 25/43 381/317 |
| 2015/0156596 | A1 * | 6/2015 | Bryant | H04R 25/55 381/315 |
| 2015/0264721 | A1 * | 9/2015 | Shilton | H04R 25/558 455/41.3 |
| 2015/0326965 | A1 * | 11/2015 | Sprague | G10L 13/043 381/317 |
| 2015/0382113 | A1 * | 12/2015 | Riepenhoff | H04R 25/554 381/314 |
| 2016/0134742 | A1 * | 5/2016 | Shennib | H04M 1/72533 455/420 |

FOREIGN PATENT DOCUMENTS

| | | | |
|---|---|---|---|
| EP | 2528356 | A1 | 11/2012 |
| EP | 2876899 | A1 | 5/2015 |
| WO | 2013189551 | A1 | 12/2013 |
| WO | 2014053023 | A1 | 4/2014 |

* cited by examiner

METHOD FOR OPERATING A HEARING DEVICE SYSTEM, HEARING DEVICE SYSTEM, HEARING DEVICE AND DATABASE SYSTEM

CROSS-REFERENCE TO RELATED APPLICATION

This application claims the priority, under 35 U.S.C. §119, of German patent application DE 10 2015 212 613.7, filed Jul. 6, 2015; the prior application is herewith incorporated by reference in its entirety.

BACKGROUND OF THE INVENTION

Field of the Invention

The invention relates to a method for operating a hearing device system. Furthermore, the invention relates to a hearing device system. In addition, the invention relates to a hearing device for such a hearing device system and to a database system for such a hearing device system.

The term "hearing device" is usually understood to mean devices that are used to output sound signals to the auditory center of a user of the relevant device (also referred to as "hearing device wearer"). In particular, this term covers hearing aids. Hearing aids are used by people with a hearing impairment to at least partially compensate for a hearing loss resulting from this hearing impairment. Usually, hearing aids have, to this end, at least one microphone for detecting an audible (ambient) sound and converting it into an electrical microphone signal. Furthermore, such hearing aids regularly have a signal processing unit that is set up to analyze the microphone signal for interference components (e.g. noise, ambient din and the like), to filter and/or attenuate these interference components and to amplify the remaining ("useful") signal components (such as particularly speech and/or music). To output the thus processed microphone signal to the auditory center, hearing aids in most cases have a loudspeaker (also referred to as a receiver) that is used to convert the processed microphone signal into an audible sound signal and to output it to the ear of the hearing device wearer. Alternatively, hearing aids have a cochlear or bone conduction implant for outputting the sound signal in electrical or mechanical form to the auditory center.

However, the term "hearing device" also covers what are known as tinnitus maskers, which frequently output user-specific noise to the auditory center, or other devices for sound output, such as e.g. headsets and the like.

Particularly in signal processing units of hearing aids, there are in most cases device-specific, comparatively complex algorithms stored for signal processing of the microphone signals, which are subsequently also referred to as "hearing device settings". In order to be able to individually adapt the respective hearing aid to suit a hearing aid wearer, these algorithms are based on variable parameters whose limits are prescribed in a wearer-specific manner when adapting the hearing aid to suit the hearing impairment of the hearing device wearer.

In order to be able to adapt to the output characteristic (sound characteristic) of the hearing device and particularly the intelligibility of speech or other "desired" useful signals to suit even different audio situations in a simple manner, hearing devices in most cases have what is known as a classifier. This is set up to take the microphone signal as a basis for inferring a specific audio situation (particularly referred to as an "aural situation"). To this end, different aural situations between which the classifier distinguishes are stored in a memory unit of the hearing device (for example "conversation of the hearing device wearer with a second person quietly", "conversation with ambient din", "period spent in natural surroundings", "period spent in a public place"). For these aural situations, adaptation of the hearing aid to suit the respective hearing device wearer in most cases involves specific parameter sets (what are known as "aural programs") being stored in the memory unit, which, depending on the output signal from the classifier, overwrite current parameters of the hearing device settings—i.e. the respective aural program corresponding to the aural situation is "loaded". In this case, the parameter sets match the respective aural situation and the hearing impairment of the hearing device wearer, so that e.g. speech or other useful signals desired in the respective aural situation is/are always output to the auditory center in a manner that is as easily intelligible as possible.

SUMMARY OF THE INVENTION

The invention is based on the object of allowing a high degree of flexibility for the signal processing of a hearing device.

The method according to the invention is used for operating a hearing device system that contains a hearing device and a database system that is separate from the hearing device. The database system is set up for communication with the hearing device. Preferably, the hearing device and the database system are set up for communication with one another (i.e. for bidirectional communication) in this case. The method involves a piece of location information being ascertained for the current position of the hearing device. This location information is subsequently transmitted to the database system. The database system ascertains whether an electronic device that is separate from the hearing device—i.e. particularly a device that is associated with a different user (device user for short) than a wearer of the hearing device (hearing device wearer for short)—is situated at a prescribed physical distance from the hearing device. Furthermore, the database system takes the (preferably simultaneous) presence of the separate device within the prescribed physical distance as a basis for creating a parameter set that contains a number of parameters pertaining to the signal processing of audible signals in the hearing device (this parameter set is referred to as "new parameter set" below). This new parameter set is—preferably in response to the transmission of the location information from the hearing device—transmitted to the hearing device by the database system. Subsequently, the new parameter set is used by the hearing device for the purpose of signal processing. That is to say that current parameters, which prescribe values for the signal processing in algorithms that are firmly prescribed in a manner specific to the hearing device (referred to as "hearing device settings" for short below), are overwritten in the hearing device with the "new" parameters of the transmitted, new parameter set.

The database system is preferably one that is accessible particularly to a plurality of different hearing devices (that are set up for communication with the database system). The database system therefore particularly forms a "central" database system that is accessible (addressable) via a network connection (mobile internet, WLAN and the like) and that is operated by a manufacturer of the hearing devices, for example. To ascertain whether the separate electronic device is situated at the prescribed distance from the hearing device, the database system is preferably also set up to communicate with such a device.

The location information pertaining to the current position of the hearing device is preferably ascertained by a satellite-assisted position finding system. Alternatively, the location information is ascertained by position finding relative to ("land-based") radio stations, such as e.g. "mobile radio masts", local access points for the internet ("hot spots") and the like. Preferably, the location information is ascertained directly by the hearing device in this case by resorting to a (satellite-assisted or radio-assisted) position finding system integrated in the hearing device. Alternatively, the location information is ascertained indirectly by the hearing device. In this case, the hearing device is connected for signal transmission purposes to a separate control unit in which the relevant position finding system is integrated. By way of example, this control unit is a smartphone or a comparable multimedia device on which a piece of control software for the hearing device is installed, or is a hearing-device-specific remote control. The location information is particularly the coordinates (for example longitudinal and latitude details) of the position. The position of the hearing device is particularly also the position of the hearing device wearer who is (currently) using the hearing device.

The separate electronic device is particularly a device that is set up and provided for transmission of position information (to a server or the like). By way of example, the separate device is a smartphone, a personal fitness monitoring device or comparable device, or particularly is a hearing device of a second hearing device wearer that is likewise set up for communication with the database system. In the latter case, the database system advantageously has a piece of information available pertaining to the position of the hearing device anyway. In the former case, the database system preferably accesses a server that stores position information for the separate electronic devices described above. In this case, the database system preferably seeks from the device user an authorization for accessing the position information of said device user. The prescribed physical distance is ascertained in a simple manner by collating the two pieces of position information (i.e. the location information of the hearing device and the position information of the separate device).

The prescribed physical distance from the hearing device is preferably understood to mean a range of up to 10 meters, particularly from 0 to 6 meters, around the hearing device.

An advantage of the invention is particularly that additional information pertaining to a current aural situation, namely particularly the presence of the separate device, is taken into account. As a result, it is advantageously possible to increase the adaptability of the signal processing of the hearing device to suit the respective current aural situation and hence the flexibility of the signal processing. Since the hearing device is provided with the new parameter set externally, it is advantageously possible to dispense with complex computation operations for ascertaining this parameter set—in a computation unit that is specifically associated with the hearing device (integrated directly in the hearing device or in the control unit)—and hence to avoid a decrease in the operating time of a battery, which in most cases is small in the case of hearing devices anyway for reasons of installation space.

In an expedient embodiment of the method, creation of the new parameter set involves a personal (individual) aural characteristic of the hearing device wearer being taken into account (by the database system). By way of example, this aural characteristic is transmitted to the database system by the hearing device (directly or indirectly via the control unit) in addition to the location information. Alternatively, the aural characteristic is transmitted to the database system and stored in a data memory associated with the database system when the hearing device is (first) adapted—this being performed particularly by a hearing device acoustician. Besides the location information, an identification data record (for example a univocal "marker") is preferably transmitted to the database system in this case, which the database system uses to identify and read the stored aural characteristic associated with the hearing device from the data memory. The aural characteristic preferably contains stipulations for attenuation and amplification of sound signals on the basis of the hearing impairment of the hearing device wearer, particularly also on the basis of frequency. The aural characteristic is therefore particularly a "basic setting" for the hearing device for signal processing, which basic setting is individually coordinated to the hearing impairment of the hearing device wearer (wearer specific). This basic setting particularly sets limits (on the basis of frequency) in the hearing device settings, within which limits it is possible for new parameters to vary when different aural programs are chosen. The effect achieved by taking into account the individual aural characteristic is advantageously that the parameters that the new parameter set contains are also compliant with the hearing impairment of the hearing device wearer.

In a preferred embodiment of the method, a personal relationship between the hearing device wearer and the device user is ascertained (particularly before the new parameter set is created). This personal relationship is taken into account when the new parameter set is created. That is to say that the new parameter set is created particularly on the basis of this personal relationship. Here and below, personal relationship is understood to mean particularly that the hearing device wearer is known to the device user (i.e. that the two know each other). By way of example, a degree of acquaintance, such as e.g. "colleague", "friend" and the like is also ascertained. If the presence of a personal relationship is ascertained, then, when the separate device is present, a conclusion is inferred that the hearing device wearer and the device user are conversing, for example. In this case, the database system creates the new parameter set preferably such that the signal processing of the hearing device is oriented to a conversation.

In an expedient embodiment of the method, the personal relationship is ascertained on the basis of a frequency with which the hearing device and the separate device are arranged within a prescribed distance from one another. That is to say that location histories are created for the hearing device and the separate device and are compared. To this end, the database system preferably ascertains a profile for the transmitted location information of the hearing device (which is particularly stored in the data memory) and a profile for the positions of the separate device. If the hearing device and the separate device were simultaneously arranged at the same location—i.e. within the prescribed distance from one another—within a prescribed period (for example 4 weeks), for a prescribed number (for example 5 times), then it is particularly inferred that the hearing device wearer and the device user at least know one another. If the hearing device and the separate device are repeatedly arranged at the same location together on a daily basis, then it is inferred that the hearing device wearer and the device user are colleagues, for example. Optionally, the database system additionally ascertains a piece of information about the respective location (position) to which the hearing device wearer and the device user are frequently situated within the prescribed distance from one another. If this position is a public place, a restaurant or the like, then it is inferred that the hearing device wearer and the device user are friends, for example. If this position is an office building or the like, then the database system particularly infers that they are colleagues.

In a preferred embodiment of the method, an additional piece of information pertaining to the current position is also ascertained and is taken into account when the new parameter set is created. If a public place or the like is involved, then the new parameter set is created particularly such that the signal processing is adapted to suit a conversation given a plurality of ambient sounds, for example, by the new parameter set. If the current position of the hearing device wearer and the device user is an office building, particularly a meeting room, then the signal processing of the hearing device is advantageously adapted to suit a conversation without ambient sounds (or at least with only negligible ambient sounds) by the new parameter set.

In an additional or alternative embodiment of the method, the personal relationship is ascertained on the basis of pieces of information that are each provided by the hearing device wearer and the device user. By way of example, the database system transmits a query to the hearing device or to the possibly associated control unit thereof and/or to the separate device. This query is particularly directed to whether the hearing device wearer knows the device user and/or vice versa or is currently in a conversation therewith. In the former case, the database system advantageously stores the respective response in the data memory, so that this information is also available in future. In an optional embodiment of the method, the database system—preferably by seeking an access authorization from the hearing device wearer and the device user—accesses a social network and retrieves therefrom a piece of information pertaining to the personal relationship between them. A social network of this kind advantageously frequently already stores information from a multiplicity of users of the social network about their personal relationship with other users and also possibly about the nature of said relationship (e.g. "known", "friends", "colleagues", "related" and the like).

In a preferred embodiment of the method, a voice profile of the device user is ascertained and is taken into account when the new parameter set is created. In this case, the new parameter set is expediently created such that the voice of the device user is particularly easily intelligible by the hearing device. Hence, a particularly high degree of individual adaptation of the signal processing of the hearing device to suit the current aural situation is possible with simultaneously low computation complexity in the hearing device. In this context, the voice profile of the device user is ascertained particularly by a microphone that is possibly arranged on the separate electronic device. In this case, a sample (i.e. a comparatively short recording) of the voice of the device user is expediently (and preferably in response to an approval by the device user) created and is transmitted to the database system for evaluation. If the separate device is likewise a hearing device that is set up for communication with the database system, then the voice profile of the device user is preferably transmitted to the database system as early as when this (second) hearing device is (first) set up.

In an expedient embodiment of the method, the new parameter set is created on the basis of a physical distance of the separate device from the hearing device, i.e. a distance between them. In particular, the new parameter set is created for a distance of 2 meters and less, for example, to the effect that the signal processing is adapted particularly to suit a single conversation between the hearing device wearer and the device user, whereas for a distance of greater than 2 meters, the signal processing is adapted by the new parameter set to suit a conversation between multiple conversation participants.

In a particularly expedient embodiment of the method, for adapting the hearing device settings stored in the hearing device by using the new parameter set, i.e. before the new parameter set is transferred to the hearing device settings, a confirmation by the hearing device wearer is requested. This prevents undesirable adaptation of the hearing device settings on the basis of a misinterpretation of the current hearing situation. In this case, the hearing device wearer is asked, particularly on the control unit that may be present or on the hearing device directly, to confirm transfer of the parameter set, for example by pressing a key. Preferably, this involves the hearing device wearer being notified of the aural situation to which the new parameter set is oriented, so that the hearing device wearer can easily assess whether he is actually in this aural situation. Particularly if the confirmation of transfer of the parameter set is to take place directly on the hearing device, there may be provision within the context of the invention for the hearing device wearer to be asked (preferably) audibly for confirmation by the push of a button. By way of example, transfer of the new parameter set is rejected in this case when confirmation has not occurred after a waiting time of 3 to 10 seconds, for example, has elapsed.

In a further expedient embodiment of the method, taking account of the additional information pertaining to the current position of the hearing device additionally also involves time-variant supplementary information pertaining to this current position being ascertained and being taken into account when the new parameter set is created. By way of example, to this end, the database system resorts to multiple parameter sets that are each specifically associated with different positions and that are stored particularly in the data memory that may be present in the database system. From these stored parameter sets, the database system preferably selects the parameter set that is specific to the current position of the hearing device. This selected new parameter set is subsequently adapted, particularly by the database system, on the basis of the time-variant supplementary information, i.e. particularly to suit the aural situation that currently (i.e. on the basis of the time of day) prevails at this location. In this case, this time-variant supplementary information is preferably retrieved by the database system, particularly via the Internet. By way of example, time-variant supplementary information of this kind is timetables for public means of transport (as a result of which an interfering sound from a passing train or the like can easily be attenuated, for example), event dates (e.g. concerts) or the like. A conversation possibly taking place between the hearing device wearer and the device user can be reproduced particularly well by the hearing device as a result of the hearing device settings being adapted to suit the current (audible) ambient conditions (the current "sound backdrop"). The reason is, by way of example, that it is recognized that a different sound backdrop can be expected in a stadium during an event (e.g. concert, sports event, etc.) that when the stadium is "unused". As part of this embodiment of the method, it is also possible to dispense with adaptation of the new parameter set on the basis of the presence of the separate device.

The hearing device system according to the invention contains the database system described above and at least one hearing device of the type described above. In this context, the hearing device (which is also regarded as a standalone invention) is set up to ascertain the location information for the current position of the hearing device (or of the hearing device wearer) and to transmit this location information to the database system. To this end, the hearing device preferably has a (satellite-assisted or radio-assisted) position finding system that is optionally integrated in the hearing device or otherwise in the control unit specifically associated with the hearing device. The database system (which is likewise regarded as a standalone invention) is set up to ascertain whether the electronic device—i.e. preferably its device user—that is separate from the hearing device is situated at the prescribed physical distance from the hearing device. Furthermore, the database system is set up to create the new parameter set for the hearing device on the basis of the presence of the separate device within this prescribed physical distance and subsequently to transmit the new parameter set to the hearing device. The hearing device is in turn set up to adapt the stored hearing device settings by means of the parameter set transmitted by the database system. In other words, the hearing device and the database system are set up and provided to perform (together) the method described above for operating the hearing device system.

Other features which are considered as characteristic for the invention are set forth in the appended claims.

Although the invention is illustrated and described herein as embodied in a method for operating a hearing device system, and a hearing device system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts are provided with the same reference symbols throughout all the figures.

Figure 1:
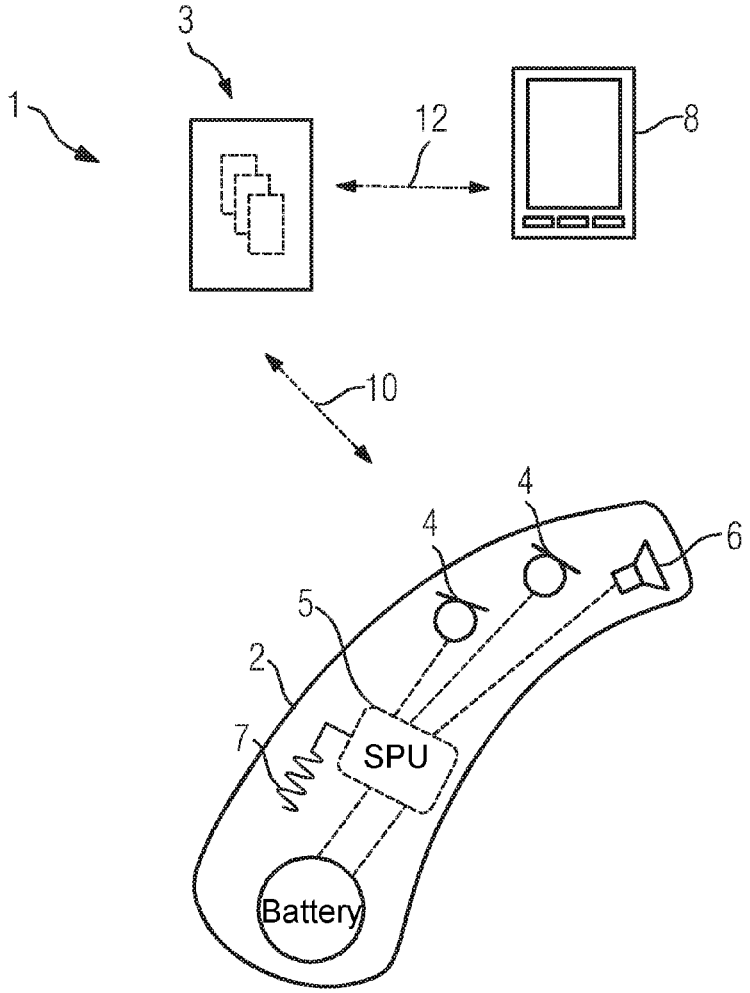
FIG. 1 is a schematic illustration showing a hearing device system that contains a hearing device and a database system according to the invention.

Referring now to the figures of the drawings in detail and first, particularly to FIG. 1 thereof, there is shown a hearing device system 1. The hearing device system 1 contains a hearing device 2 and a database system 3. The hearing device 2 has two microphones 4 for detecting an audible sound and a signal processing unit 5 for frequency-dependent filtering, attenuation and amplification of the sound signals that the sound contains. To output an output signal—generated in the signal processing unit 5 from the sound signals of the detected sound—in audible form to an ear of a hearing device wearer wearing the hearing device 2, the hearing device 2 has a loudspeaker 6. The hearing device 2 furthermore has a position finding system (not shown in more detail) that is set up to ascertain the position of the hearing device 2 with satellite assistance. In addition, the hearing device 2 is set up by an antenna 7 for wireless (bidirectional) communication with the database system 3.

The signal processing unit 5 stores algorithms (what are known as hearing device settings), which are firmly prescribed on a device-specific basis, for processing the detected sound on the basis of the hearing impairment of the hearing device wearer. However, multiple parameters in these hearing device settings are variably adaptable in order to be able to adapt the signal processing of the hearing device 2 to suit the hearing impairment of the hearing device wearer and, within carrier-specific limits—which are stored as "basic settings" when the hearing device 2 is adapted to suit the hearing device wearer—, for different aural situations. The signal processing unit 5 furthermore stores various (specifically four) parameter sets for the purpose of adaptation to suit a small number of different aural situations, which parameter sets can be loaded automatically or manually. In this case, the parameters currently used in the hearing device settings are overwritten with the parameters of the freshly loaded parameter set. By way of example, an aural situation is understood to mean a conversation between the hearing device wearer and a second person without background sounds, the period spent by the hearing device wearer in road traffic, in natural surroundings or in a room "filled" with different conversations.

The database system 3 contains (in the manner that is not shown in more detail) a number of servers for realizing a memory unit and a platform on which a control program of the database system 3 is implemented in executable form. The database system 3 is furthermore set up for (bidirectional) communication with the hearing device 2 and with other electronic devices (separate from the hearing device 2), such as e.g. a smartphone 8 as shown in FIG. 1. In the exemplary embodiment shown, the smartphone 8 is associated with a user who is different from the hearing device wearer of the hearing device 2, the user subsequently being referred to as smartphone user.

Figure 2:
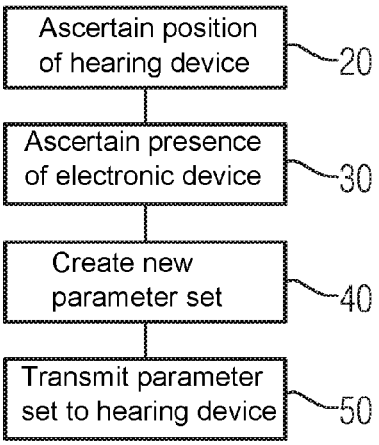
FIG. 2 is a flowchart showing a method for operating the hearing device system.

The hearing device system 1 is set up to perform a method that is described in more detail below with reference to FIG. 2. To this end, a method step 20 first of all involves the hearing device 2 using the position finding system to ascertain the position of the hearing device 2 and transmitting the position as location information to the database system 3 (see FIG. 1, dash-dotted arrow 10). A method step 30 involves the database system 3 ascertaining whether there is any electronic device, separate from the hearing device 2 and carried by a user, situated within a prescribed range of less than 6 meters from the hearing device 2. In the exemplary embodiment shown in FIG. 1, the database system 3 specifically ascertains a position for the smartphone 8 (see dashed arrow 12) and infers from this position whether the smartphone 8 is situated in the prescribed range around the hearing device 2, i.e. whether the hearing device wearer and the smartphone user are situated close to one another.

If the smartphone 8 is situated in this range around the hearing device 2, then a method step 40 involves the database system 3 creating a new parameter set for the signal processing unit 5 of the hearing device 3. Creation of the new parameter set involves the database system 3 taking into account the distance between the hearing device 2 and the smartphone 8 and also a voice profile of the smartphone user that has been transmitted from the smartphone 8 to the database system 3. Furthermore, the database system 3 ascertains a personal relationship between the hearing device wearer and the smartphone user, specifically whether the hearing device wearer and the smartphone user know one another. This is ascertained via the database system 3 on the basis of a query that is transmitted to the hearing device wearer. In an alternative exemplary embodiment, the personal relationship is ascertained on the basis of a history of the position data of the hearing device 2 and the smartphone 8. In another alternative exemplary embodiment, the database system 3 queries, provided that there is appropriate clearance from the hearing device wearer and the smartphone user, a personal relationship between the two people from a social network. In this exemplary embodiment, the clearance for this can be provided by a confirmation when a user account for the social network is created or when the hearing device 2 and possibly the smartphone 8 is/are registered in the database system 3, for example.

On the basis of the personal relationship, specifically when the hearing device wearer and the smartphone user know one another, the database system 3 infers, when the smartphone 8 is at a distance of less than 3 meters from the hearing device 2, that the hearing device wearer and smartphone user are in a conversation. By utilizing the voice profile of the smartphone user, the database system 3 subsequently creates the new parameter set in method step 40 such that the hearing device wearer is afforded, in his conversation with the smartphone user, a particularly high degree of perceptibility and intelligibility for the voice of the smartphone user.

In a further method step 50, the database system 3 transmits the new parameter set to the hearing device 2. The latter seeks from the hearing device wearer a confirmation for the current parameters of the hearing device settings to be overwritten with those of the transmitted, new parameter set. In response to the confirmation, the signal processing is adapted by the new parameters. This method achieves a high degree of individual adaptability for the hearing device 2 to suit the present aural situation, that is to say, in the present exemplary embodiment, to suit the conversation between the hearing device wearer and the smartphone user.

Figure 3:
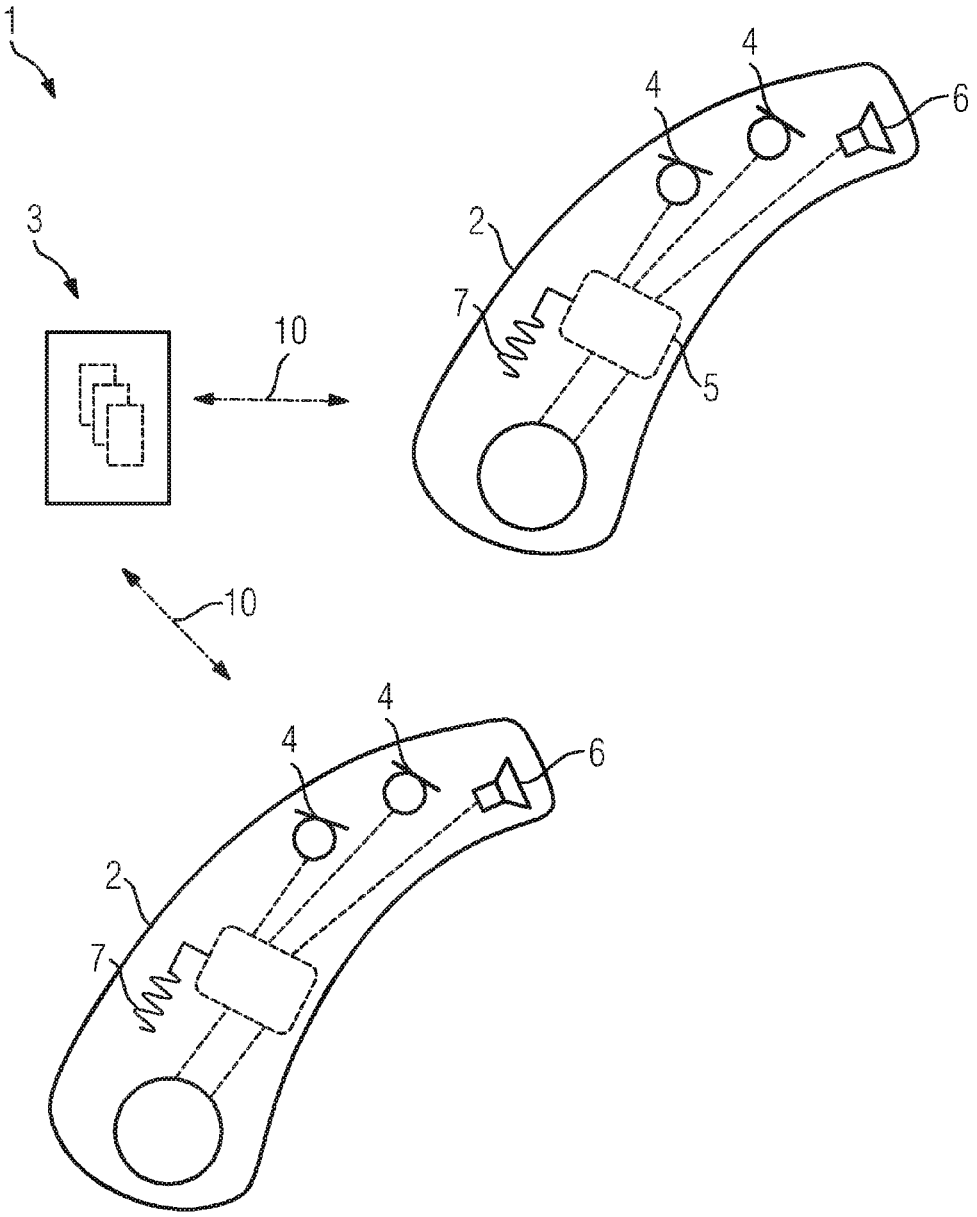
FIG. 3 is an illustration as shown in FIG. 1 to show a further exemplary embodiment of the hearing device system.

In a further exemplary embodiment as shown in FIG. 3, the hearing device system 1 contains two hearing devices 2 of the same type that are each associated with a different hearing device wearer. In this case, one of the two hearing devices 2 forms the electronic device that is separate from the other hearing device 2. The method performed in this case differs from the method described in FIG. 2 merely in that the database system 3 is provided with the positions of both hearing devices 2 in method step 20, and that a new parameter set is then created for each hearing device 2. In this context, the voice profile of the other hearing device wearer is taken into account in each case—provided that the two hearing device wearers are situated within the prescribed distance of one another. In this case, the respective voice profile has already been ascertained and transmitted to the database system 3 when the respective hearing device 2 was adapted for the relevant hearing device wearer. Hearing device wearers having hearing devices of the same type (according to the description above) that are in a conversation with one another are therefore afforded a particularly high degree of mutual speech intelligibility.

The subject matter of the invention is not limited to the exemplary embodiments described above. Rather, further embodiments of the invention can be derived from the description above by a person skilled in the art. In particular, the individual features of the invention that are described on the basis of the different exemplary embodiments, and the refinement variants of said individual features, can also be combined with one another in other ways.

The following is a summary list of reference numerals and the corresponding structure used in the above description of the invention:

1 Hearing device system
2 Hearing device
3 Database system
4 Microphone
5 Signal processing unit
6 Loudspeaker
7 Antenna
8 Smartphone
10 Arrow
11 Arrow
20 Method step
40 Method step
50 Method step

The invention claimed is:

1. A method for operating a hearing device system having a hearing device and a database system being separate from the hearing device and set up for communication with the hearing device, which comprises the steps of:

ascertaining a piece of location information for a current position of the hearing device;

transmitting the location information to the database system;

ascertaining via the database system if an electronic device that is separate from the hearing device is situated at a prescribed physical distance from the hearing device;

creating for the hearing device a parameter set that contains a number of parameters for signal processing of audible signals in the hearing device if the database system detects a presence of the electronic device within the prescribed physical distance;

transmitting via the database system the parameter set created to the hearing device; and using the parameter set transmitted by the database system in the hearing device for the signal processing.

2. The method according to claim 1, which further comprises during a creation of the parameter set, taking into account a personal aural characteristic of a wearer of the hearing device.

3. The method according to claim 1, which further comprises:

ascertaining a personal relationship between a wearer of the hearing device and a user of the electronic device; and creating the parameter set based on the personal relationship.

4. The method according to claim 3, which further comprises ascertaining the personal relationship on a basis of a frequency with which the hearing device and the electronic device are disposed within the prescribed physical distance from one another.

5. The method according to claim 3, which further comprise ascertaining the personal relationship on a basis of pieces of information that are each provided by the wearer of the hearing device and the user of the electronic device.

6. The method according to claim 1, which further comprises ascertaining a voice profile of a user of the electronic device and the voice profile is taken into account for creation of the parameter set.

7. The method according to claim 1, which further comprises creating the parameter set on a basis of a distance of the electronic device from the hearing device.

8. The method according to claim 1, wherein hearing device settings stored in the hearing device are adapted by using the parameter set after receiving a confirmation from a wearer of the hearing device.

9. A hearing device system, comprising:

a database system;

at least one hearing device set up to ascertain a piece of location information for a current position of said hearing device and to transmit the location information to said database system;

said database system being set up to ascertain whether an electronic device that is separate from said hearing device is situated at a prescribed physical distance from said hearing device, and to take a presence of the electronic device within the prescribed physical distance as a basis for creating for said hearing device a parameter set that contains parameters pertaining to signal processing of audible signals in said hearing device and to transmit the parameter set created to said hearing device; and said hearing device being set up to use the parameter set transmitted by said database system for the signal processing.

10. A hearing device for a hearing device system having a database system, the hearing device comprising:

the hearing device being set up to communicate with the database system of the hearing device system;

the hearing device being set up to ascertain a piece of location information for a current location of the hearing device and to transmit the location information to the database system;

the database system set up to ascertain whether an electronic device that is separate from the hearing device is situated at a prescribed physical distance from the hearing device, and to take a presence of the electronic device within the prescribed physical distance as a basis for creating for the hearing device a parameter set that contains parameters pertaining to signal processing of audible signals in the hearing device and to transmit the parameter set created to the hearing device; and the hearing device being set up to use the parameter set transmitted by the database system for the signal processing.

11. A database system for a hearing device system having a hearing device, the database system comprising:

a database set up to communicate with the hearing device of the hearing device system;

the hearing device is set up to ascertain a piece of location information for a current position of the hearing device and to transmit the location information to said database;

said database set up to ascertain whether an electronic device that is separate from the hearing device is situated at a prescribed physical distance from the hearing device, and to take a presence of the electronic device within the prescribed physical distance as a basis for creating for the hearing device a parameter set that contains parameters pertaining to signal processing of audible signals in the hearing device and to transmit the parameter set created to the hearing device; and the hearing device is set up to use the parameter set transmitted by the database system for the signal processing.

* * * * *